US009103010B2

(12) United States Patent
Mizuno et al.

(10) Patent No.: US 9,103,010 B2
(45) **Date of Patent: *Aug. 11, 2015**

(54) MAGNESIUM ALLOY STRUCTURAL MEMBER

(75) Inventors: Osamu Mizuno, Itami (JP); Nobuyuki Okuda, Itami (JP); Koji Mori, Itami (JP); Masahiro Yamakawa, Osaka (JP); Masayuki Nishizawa, Itami (JP); Takayasu Sugihara, Osaka (JP)

(73) Assignee: SUMITOMO ELECTRIC INDUSTRIES, LTD., Osaka (JP)

( * ) Notice: Subject to any disclaimer, the term of this patent is extended or adjusted under 35 U.S.C. 154(b) by 647 days.

This patent is subject to a terminal disclaimer.

(21) Appl. No.: 13/515,155

(22) PCT Filed: Dec. 6, 2010

(86) PCT No.: PCT/JP2010/071848

§ 371 (c)(1),
(2), (4) Date: Jun. 11, 2012

(87) PCT Pub. No.: WO2011/071023

PCT Pub. Date: Jun. 16, 2011

(65) Prior Publication Data

US 2012/0308809 A1 Dec. 6, 2012

(30) Foreign Application Priority Data

Dec. 11, 2009 (JP) ..... 2009-282081

(51) Int. Cl.

| | |
|---|---|
| ***C22C 23/02*** | (2006.01) |
| ***C22F 1/06*** | (2006.01) |
| ***B22D 11/00*** | (2006.01) |
| ***C23C 22/22*** | (2006.01) |
| ***C23C 28/02*** | (2006.01) |
| ***C23C 30/00*** | (2006.01) |

(52) U.S. Cl.

CPC ..... *C22F 1/06* (2013.01); *B22D 11/001* (2013.01); *C22C 23/02* (2013.01); *C23C 22/22* (2013.01); *C23C 28/021* (2013.01); *C23C 28/028* (2013.01); *C23C 30/00* (2013.01); *Y10T 428/256* (2015.01)

(58) Field of Classification Search

None

See application file for complete search history.

(56) References Cited

U.S. PATENT DOCUMENTS

| | | | | |
|---|---|---|---|---|
| 6,139,651 | A | 10/2000 | Bronfin et al. | |
| 6,143,097 | A | 11/2000 | Fujita et al. | |
| 8,906,294 | B2 * | 12/2014 | Mizuno et al. | 420/407 |
| 2012/0282131 | A1 | 11/2012 | Mizuno et al. | |

FOREIGN PATENT DOCUMENTS

| | | | |
|---|---|---|---|
| CN | 101512028 | A | 8/2009 |
| EP | 0665299 | A1 | 8/1995 |
| JP | 07-224344 | A | 8/1995 |
| JP | 09024338 | A | 1/1997 |
| JP | H09-024338 | A | 1/1997 |
| JP | 2005-281717 | A | 10/2005 |
| JP | 2006-291327 | A | 10/2006 |
| JP | 2007-031789 | A | 2/2007 |
| JP | 2007-327115 | A | 12/2007 |
| JP | 2008-106337 | A | 5/2008 |
| JP | 2011-017041 | A | 1/2011 |
| RU | 2213796 | C2 | 10/2003 |
| WO | WO 2006/003899 | A1 | 1/2006 |
| WO | WO 2008/029497 | A1 | 3/2008 |
| WO | WO 2009/001516 | A1 | 12/2008 |

OTHER PUBLICATIONS

Notification of the First Office Action for corresponding Chinese Patent Application No. 2010800561415, dated Nov. 5, 2013, 19 pages.

Notification of Reasons for Rejection for corresponding Japanese Patent Application No. 2010-260382, dated Dec. 4, 2013, 5 pages (Partial English Translation included).

International Search Report for PCT Application No. PCT/JP2010/071848 dated Mar. 8, 2011, pp. 1-2.

Chinese Office Action for related Chinese Patent Application No. 201080056199.X dated May 6, 2013, 14 pages.

Russian Office Action for related Russian Patent Application No. 2012129180 dated Oct. 10, 2013, 11 pages.

International Preliminary Report on Patentability for International Application No. PCT/JP2010/071849, mailed Mar. 8, 2011, 1 pages.

* cited by examiner

*Primary Examiner* — Sheeba Ahmed

(74) *Attorney, Agent, or Firm* — Ditthavong & Steiner, P.C.

(57) ABSTRACT

A magnesium alloy structural member having excellent corrosion resistance is provided. The magnesium alloy structural member includes a magnesium alloy substrate that contains more than 7.5% by mass of Al and an anticorrosive layer formed on a surface of the substrate by chemical conversion treatment. The substrate contains a precipitate, typically, particles dispersed therein. The particles are made of an intermetallic compound containing at least one of Al and Mg and have an average particle size of 0.05 μm or more and 1 μm or less. The total area of the particles accounts for 1% by area or more and 20% by area or less. The anticorrosive layer includes a lower sublayer and a surface sublayer on the substrate in this order. The surface sublayer is denser than the lower sublayer. The substrate of the magnesium alloy structural member has high corrosion resistance because of a high Al content. The magnesium alloy structural member has excellent corrosion resistance because of the dense sublayer on the front side of the anticorrosive layer, which prevents a corrosive liquid from reaching the substrate. The porous lower sublayer can reduce the tendency of the anticorrosive layer to detach from the substrate, for example, upon impact and allows the magnesium alloy structural member to retain high corrosion resistance.

5 Claims, 2 Drawing Sheets

(I) SUBSTRATE OF SAMPLE No. 1
(MAGNESIUM ALLOY SHEET)

1 μm (II) SUBSTRATE OF SAMPLE No. 110
(MAGNESIUM ALLOY SHEET)

1 μm (I) SAMPLE No. 1
(MAGNESIUM ALLOY STRUCTURAL MEMBER)

(II) SAMPLE No. 110
(MAGNESIUM ALLOY STRUCTURAL MEMBER)

MAGNESIUM ALLOY STRUCTURAL MEMBER

TECHNICAL FIELD

The present invention relates to a magnesium alloy structural member suitable for parts, such as housings for mobile electronic devices. In particular, the present invention relates to a magnesium alloy structural member having excellent corrosion resistance.

BACKGROUND ART

Light-weight magnesium alloys having excellent specific strength and specific rigidity are being studied as constituent materials of parts, such as housings for mobile electronic devices, including cellular phones and laptop computers. Magnesium alloy parts are mainly made of cast materials manufactured by a die-casting process or a thixomold process (AZ91 alloy as defined in the American Society for Testing and Materials standards). In recent years, parts manufactured by press forming of a sheet made of a wrought magnesium alloy exemplified by AZ31 alloy as defined in the American Society for Testing and Materials standards have been used. Patent Literatures 1 and 2 disclose press forming of a rolled sheet manufactured under particular conditions from AZ91 alloy or an alloy that has substantially the same Al content as AZ91 alloy.

Magnesium alloys generally have low corrosion resistance. Thus, as disclosed in Patent Literature 1, magnesium alloys are subjected to surface treatment, such as chemical conversion treatment or anodizing treatment, to improve corrosion resistance. Furthermore, the compositions of magnesium alloys may be adjusted to improve corrosion resistance. For example, AZ91 alloy having a higher Al content than AZ31 alloy has excellent corrosion resistance.

CITATION LIST

Patent Literature

PTL 1: International Publication No. 2008/029497
PTL 2: International Publication No. 2009/001516

SUMMARY OF INVENTION

Technical Problem

However, it is desirable to further improve the corrosion resistance of magnesium alloy structural members.

As described above, performing surface treatment or increasing the amount of additive element, such as Al, can improve the corrosion resistance of magnesium alloys. However, it is difficult to further improve the corrosion resistance of magnesium alloy structural members only through these measures.

As a result of investigations, the present inventors found that the state of an anticorrosive layer on a magnesium alloy material formed by surface treatment, such as chemical conversion treatment, depends on the material composition or a method for manufacturing the material. Different states result in variations in corrosion resistance.

More specifically, chemical conversion treatment of an AZ31 alloy wrought material and an AZ91 alloy cast material results in a much thicker anticorrosive layer in the AZ31 alloy wrought material than in the AZ91 alloy cast material. However, the anticorrosive layer was porous. Thus, a corrosive liquid reaches the magnesium alloy material through the anticorrosive layer, resulting in the material having poor corrosion resistance. Furthermore, an excessively thick anticorrosive layer may cause a crack because of extreme stress in the anticorrosive layer, allowing a corrosive liquid to reach the material. Thus, the AZ31 alloy wrought material can have lower corrosion resistance than the AZ91 alloy cast material.

On the other hand, the anticorrosive layer of the AZ91 alloy cast material has a smaller thickness than the anticorrosive layer of the AZ31 alloy wrought material but is still thick enough to cause a crack. Thus, the AZ91 alloy cast material can have low corrosion resistance.

The chemical conversion treatment of a magnesium alloy sheet made of AZ91 alloy disclosed in Patent Literatures 1 and 2 results in the formation of an anticorrosive layer having a smaller thickness than the anticorrosive layer of the cast material, making it difficult to cause a crack. However, it is still desirable to further improve corrosion resistance.

Accordingly, it is an object of the present invention to provide a magnesium alloy structural member having excellent corrosion resistance.

Solution to Problem

In order to improve the corrosion resistance of magnesium alloy, the present inventors manufactured sheets of a magnesium alloy that contains more than 7.5% by mass of Al by various methods. After the sheets were subjected to chemical conversion treatment, the state and the corrosion resistance of the anticorrosive layer were examined. The present inventors found that magnesium alloy sheets manufactured under particular conditions had excellent corrosion resistance.

More specifically, in magnesium alloy structural members that had high corrosion resistance after the formation of an anticorrosive layer, the magnesium alloy substrate contains a certain amount of precipitate, such as an intermetallic compound containing at least one of Mg and Al, including $Mg_{17}Al_{12}$ or $Al_6(MnFe)$. The precipitate had a relatively small particle size, is uniformly dispersed, and is substantially free from coarse particles, for example, having a size of 5 μm or more. Thus, a manufacturing process that can control the size and number of precipitate particles, that is, that can prevent the formation of coarse precipitate particles and produce a certain number of fine precipitate particles was investigated. As a result, the present inventors found that, in manufacturing processes up to the point where the end product is formed after casting, in particular, after solution treatment, it is preferable to control the manufacturing conditions such that a magnesium alloy material is held in a particular temperature range for a given total time.

It was also found that chemical conversion treatment of a substrate that contains uniformly dispersed fine precipitate particles, for example, made of an intermetallic compound results in the formation of an anticorrosive layer having a two-layer structure that includes a relatively sparse sublayer adjacent to the substrate and a dense outer sublayer.

The present invention is based on these findings. A magnesium alloy structural member according to the present invention includes a magnesium alloy substrate that contains more than 7.5% by mass of Al and an anticorrosive layer formed on a surface of the substrate by chemical conversion treatment. The substrate contains precipitate particles dispersed therein, and the precipitate particles have an average particle size of 0.05 μm or more and 1 μm or less. The total area of the precipitate particles in a cross section of the magnesium alloy structural member accounts for 1% or more and 20% or less of the cross section. The anticorrosive layer has a two-layer structure that includes a lower sublayer adjacent to the substrate and a surface sublayer formed on top of the lower sublayer. The surface sublayer is denser than the lower sublayer.

In the manufacture of a magnesium alloy structural member according to the present invention, the following magnesium alloy sheet is suitably used as the substrate. The magnesium alloy sheet is made of a magnesium alloy that contains more than 7.5% by mass of Al. The magnesium alloy sheet contains precipitate particles dispersed therein. The precipitate particles have an average particle size of 0.05 μm or more and 1 μm or less. The total area of the precipitate particles in a cross section of the magnesium alloy sheet accounts for 1% or more and 20% or less of the cross section.

The substrate or the magnesium alloy sheet of a magnesium alloy structural member according to the present invention is substantially free from coarse precipitate particles and contains very fine precipitate particles dispersed therein. This can reduce a decrease in the amount of Al dissolved in the magnesium alloy resulting from the presence of coarse precipitate particles or excessive precipitation and reduce the deterioration in the corrosion resistance of the magnesium alloy resulting from a decrease in the amount of dissolved Al.

In the anticorrosive layer formed by the chemical conversion treatment of the substrate or the magnesium alloy sheet that contains fine precipitate particles dispersed therein, the dense surface sublayer prevents a corrosive liquid from reaching the substrate, thereby improving the corrosion resistance of the magnesium alloy structural member. The relatively sparse lower sublayer adjacent to the substrate can reduce the tendency of the anticorrosive layer to detach from the substrate upon impact, such as heat shock. The anticorrosive layer has a relatively small thickness and high resistance to cracking Thus, a magnesium alloy structural member according to the present invention can retain the dense surface sublayer having excellent corrosion resistance for a long period of time and have excellent corrosion resistance.

In a magnesium alloy structural member according to the present invention, a large amount of dissolved Al can improve the corrosion resistance of its base material, and the anticorrosive layer having excellent corrosion resistance, peel resistance, and crack resistance can provide higher corrosion resistance than conventional magnesium alloy structural members.

Furthermore, the dispersion of fine precipitate particles can improve the rigidity of the sheet through dispersion strengthening, and reducing a decrease in the amount of dissolved Al can ensure the strength of the sheet. Thus, the substrate or the magnesium alloy sheet is rarely dented by impacts and has excellent impact resistance. Furthermore, the substrate or the magnesium alloy sheet that is substantially free from coarse precipitate particles has excellent plastic formability and is easily subjected to press forming.

The substrate or the magnesium alloy sheet having the particular structure described above can be manufactured by a method including the following processes.

Preparation process: a process of preparing a cast sheet made of a magnesium alloy that contains more than 7.5% by mass of Al and manufactured by a continuous casting process.

Solution process: a process of performing solution treatment of the cast sheet at a temperature of 350° C. or more to manufacture a solid solution sheet.

Rolling process: a process of performing warm rolling of the solid solution sheet to manufacture a rolled sheet.

In particular, in manufacturing processes after the solution process, the thermal history of a material sheet to be processed (typically a rolled sheet) is controlled such that the total time of holding the material sheet at a temperature of 150° C. or more and 300° C. or less is 0.5 hours or more and less than 12 hours and that the material sheet is not heated to a temperature of more than 300° C.

The manufacturing processes may further include a straightening process of straightening the rolled sheet. The straightening process may involve straightening while the rolled sheet is heated at a temperature of 100° C. or more and 300° C. or less, that is, warm straightening. In the case that the straightening process involves warm straightening, the total time includes the time of holding the rolled sheet at a temperature of 150° C. or more and 300° C. or less in the straightening process.

A magnesium alloy structural member according to the present invention can be manufactured by a method that includes the preparation of a rolled sheet formed by the method for manufacturing a magnesium alloy sheet described above or a straightened sheet formed by the straightening process as a base material, a plastic forming process of performing plastic forming of the base material, and a surface treatment process of performing chemical conversion treatment of the base material. Plastic forming after the surface treatment process may cause damage to a surface of the base material and impair the effects of the surface treatment. Thus, the surface treatment process is preferably preceded by the plastic forming process.

As described above, solution treatment allows Al to be sufficiently dissolved in the magnesium alloy. In the manufacturing processes after the solution treatment, the magnesium alloy material is held in a particular temperature range (150° C. to 300° C.) for a particular time range such that a predetermined amount of precipitate can be easily precipitated. Furthermore, the holding time in the particular temperature range can be controlled so as to prevent the excessive growth of the precipitate and allow fine precipitate particles to be dispersed.

In the case that rolling is performed more than once (multipass) with an appropriate degree of processing (rolling reduction) to achieve a desired sheet thickness in the rolling process, a target to be processed (a material after the solution treatment; for example, a rolled sheet before the final rolling) can be heated to a temperature of more than 300° C. so as to improve plastic formability and facilitate rolling. With an Al content as high as more than 7.5% by mass, however, heating to a temperature of more than 300° C. may accelerate the precipitation of an intermetallic compound or the growth of a precipitate to form coarse particles. The excessive production or growth of the precipitate results in a decrease in the amount of dissolved Al in the magnesium alloy. A decrease in the amount of dissolved Al results in low corrosion resistance of the magnesium alloy. With a decrease in the amount of dissolved Al, it is difficult to further improve the corrosion resistance even by the formation of an anticorrosive layer.

Furthermore, in order to improve press formability through recrystallization or remove strain resulting from plastic forming, heat treatment is generally performed during or after rolling or after plastic forming, such as press forming. The heat treatment temperature tends to be increased with the Al content. For example, Patent Literature 1 proposes heat treatment of AZ91 alloy after rolling (the final annealing) at a temperature in the range of 300° C. to 340° C. Heat treatment at a temperature of more than 300° C. also accelerates the growth of a precipitate to form coarse particles. Thus, the thermal history of a material sheet is controlled as described above.

The present invention will be described in detail below.

[Magnesium Alloy Structural Member]

<Substrate>

(Composition)

A magnesium alloy constituting the substrate may have a composition in which Mg is combined with an additive element (the remainder: Mg and impurities, Mg: 50% by mass or more). In particular, in the present invention, the magnesium alloy is a Mg—Al alloy in which the additive element contains at least more than 7.5% by mass of Al. More than 7.5% by mass of Al can improve not only the corrosion resistance but also the mechanical characteristics, such as strength and plastic deformation resistance, of the magnesium alloy. The corrosion resistance tends to increase with the Al content. However, more than 12% by mass of Al results in poor plastic formability and requires heating of the material during rolling. Thus, the Al content is preferably 12% by mass or less.

The additive element other than Al may be one or more elements selected from the group consisting of Zn, Mn, Si, Ca, Sr, Y, Cu, Ag, Be, Sn, Li, Zr, Ce, Ni, Au, and rare-earth elements (except Y and Ce). Each of the elements may constitute 0.01% by mass or more and 10% by mass or less, preferably 0.1% by mass or more and 5% by mass or less, of the magnesium alloy. For example, specific Mg—Al alloy may be AZ alloy (Mg—Al—Zn alloy, Zn: 0.2% to 1.5% by mass), AM alloy (Mg—Al—Mn alloy, Mn: 0.15% to 0.5% by mass), Mg—Al—RE (rare-earth element) alloy, AX alloy (Mg—Al—Ca alloy, Ca: 0.2% to 6.0% by mass), or AJ alloy (Mg—Al—Sr alloy, Sr: 0.2% to 7.0% by mass) as defined in the American Society for Testing and Materials standards. In particular, 8.3% to 9.5% by mass of Al can improve both corrosion resistance and strength. One specific example is a Mg—Al alloy that contains 8.3% to 9.5% by mass of Al and 0.5% to 1.5% by mass of Zn, typically AZ91 alloy. 0.001% by mass or more in total, preferably 0.1% by mass or more and 5% by mass or less in total, of at least one element selected from Y, Ce, Ca, and rare-earth elements (except Y and Ce) can improve heat resistance and flame resistance.

(Form)

Typically, the substrate may be a sheet (a magnesium alloy sheet) before plastic forming, such as press forming, including bending and drawing. Typically, the sheet may be rectangular. Alternatively, the sheet may be circular or of another shape. The sheet may have a boss or a through-hole from the front side to the back side. The sheet may be a short sheet having a predetermined length and shape as described above or a coiled sheet of a continuous long sheet. The sheet may have any form depending on the manufacturing processes. For example, the form may be a rolled sheet, a heat-treated or straightened sheet manufactured by heat treatment or straightening of a rolled sheet as described below, or a polished sheet manufactured by polishing of the rolled, heat-treated, or straightened sheet. Another form of the substrate may be a formed product manufactured by plastic forming, such as press forming, including bending and drawing, of the sheet. The substrate may have any form, size (area), or thickness depending on its desired application. In particular, a substrate having a thickness of 2.0 mm or less, preferably 1.5 mm or less, more preferably 1 mm or less, can be suitably used for thin and light-weight parts (typically, housings and parts of automobiles).

The formed product may have any shape and size, for example, a box or frame having a U-shaped cross section that includes a top (a bottom) and a sidewall extending perpendicularly from the top (bottom) or a covered tube that includes a discoidal top and a cylindrical sidewall. The top may have an integral or attached boss, a through-hole from the front side to the back side, a groove in the thickness direction, a step, or a portion having a different thickness formed by plastic forming or cutting. The substrate may partly have a portion formed by plastic forming, such as press forming. In the case that the substrate is the formed product or has a portion formed by plastic forming, a portion having less plastic deformations (typically, a flat portion) substantially retains the structure and mechanical characteristics of a sheet (magnesium alloy sheet) that has been used as the material for the plastic forming.

(Precipitate)

The substrate contains fine precipitate particles, for example, having an average particle size in the range of 0.05 μm to 1 μm dispersed therein. The precipitate particles constitute 1% to 20% by area of the substrate. The precipitate particles may be particles that contain an additive element in a magnesium alloy, typically, particles made of an intermetallic compound containing Mg or Al, more specifically, $Mg_{17}Al_{12}$ (not particularly limited to $Mg_{17}Al_{12}$). When the precipitate particles have an average particle size of 0.05 μm or more and when the precipitate content is 1% by area or more, the substrate has excellent corrosion resistance because of a sufficient number of precipitate particles, and a single thick anticorrosive layer, for example, made of an AZ91 alloy cast material can be formed to prevent deterioration of corrosion resistance. When the precipitate particles have an average particle size of 1 μm or more and when the precipitate content is 20% by area or less, this can prevent the production of excessive precipitate particles in the substrate or the production of coarse precipitate particles, thus preventing a decrease in the amount of dissolved Al and improving corrosion resistance. In addition, this can prevent the formation of a porous anticorrosive layer alone, thus improving corrosion resistance. The precipitate particles more preferably have an average particle size of 0.1 μm or more and 0.5 μm or less, and the precipitate content is more preferably 3% by area or more and 15% by area or less, still more preferably 5% by area or more and 10% by area or less.

These matters relating to the substrate except part of the forms are true for the magnesium alloy sheet.

<Anticorrosive Layer>

(Formation Mechanism of Anticorrosive Layer)

An anticorrosive layer having a two-layer structure formed by chemical conversion treatment is disposed on a surface of the substrate. When an anticorrosive layer is formed on a magnesium alloy material using a phosphate solution containing manganese (Mn) and calcium (Ca) as a chemical conversion treatment liquid, the immersion of the material in the chemical conversion treatment liquid causes Mg in the material to dissolve in the chemical conversion treatment liquid and thereby changes the acid concentration (pH) of the chemical conversion treatment liquid near the material, hydrolyzing $Mn(H_2PO_4)_2$ or $Ca(H_2PO_4)_2$ in the chemical conversion treatment liquid. The hydrolysis results in the formation of a Mn and Ca phosphate film (an anticorrosive layer). With an increase in the amount of Mg that dissolves in the chemical conversion treatment liquid (or an increase in the dissolution speed of Mg), the anticorrosive layer tends to be formed more rapidly in a larger thickness.

When the material is composed of AZ31 alloy, a low Al (dissolved Al) content of the material and the material surface rich in Mg result in a large amount of Mg that dissolves in the chemical conversion treatment liquid, resulting in rapid formation of an anticorrosive layer. Thus, the anticorrosive layer can be porous and thick.

On the other hand, when the material is composed of AZ91 alloy, a high Al (dissolved Al) content of the material results in a smaller amount of Mg that dissolves in the chemical conversion treatment liquid than AZ31 alloy, resulting in an anticorrosive layer having a smaller thickness than AZ31 alloy. Although the detailed mechanism is not clear, an anticorrosive layer of an AZ91 alloy cast material is porous and relatively thick. Even with a AZ91 alloy rolled material, a high material temperature during rolling, a long holding time at a temperature in the range of 150° C. to 300° C. because of a high final annealing temperature, or thermal history of more than 300° C. (this material is hereinafter referred to as a comparative rolled material) may result in a reduced amount of dissolved Al in the material because of the growth of a precipitate or an excessive amount of precipitate, that is, a relatively increase in Mg on the material surface. This may result in a relatively large amount of Mg that dissolves in the chemical conversion treatment liquid, forming a porous and relatively thin anticorrosive layer.

In the substrate or the magnesium alloy sheet, the presence of fine precipitate particles in a particular area of the material results in a relatively large amount of dissolved Al in the material and a smaller amount of Mg that dissolves in the chemical conversion treatment liquid than the comparative rolled material. Thus, a porous film is formed in the anticorrosive layer adjacent to the substrate, and a dense film is formed on the surface of the porous film.

(Structure)

A surface sublayer of an anticorrosive layer of a magnesium alloy structural member according to the present invention is denser than a lower sublayer adjacent to the substrate. In other words, the lower sublayer is more porous than the surface sublayer. The term "sparse" and "dense" in relation to the anticorrosive layer mean that, for example, in a microscope image of a cross section of a magnesium alloy structural member according to the present invention, with respect to the anticorrosive layer with a 256 gray scale, the surface sublayer has a dispersion (standard deviation) in gray scale of 6 or more and 10 or less, and the lower sublayer has a dispersion (standard deviation) in gray scale of 13 or more and 17 or less. A smaller dispersion in gray scale indicates a denser state with less pores, and a larger dispersion indicates a more porous (sparser) state. The 256 gray scale expression can be easily obtained with a commercial image analyzer. A magnesium alloy structural member according to the present invention that includes an anticorrosive layer having a two-layer structure of a dense sublayer and a sparse sublayer can have excellent corrosion resistance as well as high crack resistance and peel resistance.

(Thickness)

An anticorrosive layer of a magnesium alloy structural member according to the present invention has a much smaller thickness than an anticorrosive layer of a material made of a magnesium alloy that contains a small amount of Al, such as AZ31 alloy. More specifically, the anticorrosive layer having a two-layer structure has a total thickness of 50 nm or more and 300 nm or less. The porous lower sublayer constitutes approximately 60% to 75% of the total thickness, and the surface sublayer constitutes the remainder. Even with such a thin anticorrosive layer, a magnesium alloy structural member according to the present invention has excellent corrosion resistance, and the thin anticorrosive layer is resistant to cracking Furthermore, the thin anticorrosive layer has little influence on the dimensions and appearance of the end product. However, an excessively thin anticorrosive layer tends to have poor corrosion resistance, and an excessively thick anticorrosive layer also has poor corrosion resistance because of cracking as described above. Thus, the anticorrosive layer more preferably has a total thickness of 50 nm or more and 200 nm or less. The thickness of the anticorrosive layer depends on the time of chemical conversion treatment and the Al content.

(Composition)

The material of the anticorrosive layer can vary with the chemical conversion treatment liquid. The chemical conversion treatment liquid conventionally contains chromium (Cr) (chromate treatment liquids). However, from the standpoint of environmental conservation, it is desirable to use chromium-free treatment liquids. Examples of the chromium-free treatment liquids include phosphate solutions, more specifically, manganese and calcium phosphate solutions and calcium phosphate solutions. A manganese and calcium phosphate solution forms an anticorrosive layer mainly composed of a phosphate compound of manganese and calcium.

The lower sublayer adjacent to the substrate in the anticorrosive layer contains more Al than the surface sublayer and therefore has excellent adhesion to the substrate containing Al. Furthermore, because of being porous, the lower sublayer can alleviate impacts, such as heat shock, and prevent the detachment of the anticorrosive layer upon impact. The dense surface sublayer containing more manganese and calcium than the lower sublayer is resistant to oxidation by a corrosive liquid, such as an acid, and prevents the corrosive liquid from reaching the substrate, thus achieving high corrosion resistance.

[Manufacturing Processes]

(Preparation Process)

The cast sheet is preferably manufactured by a continuous casting process, such as a twin-roll process, in particular, a casting process described in WO 2006-003899. The continuous casting process can reduce the formation of oxides and segregation by means of rapid solidification and prevent the formation of coarse impurities in crystal and precipitated impurities having a size of more than 10 μm, which can be starting points of cracking. Thus, the cast sheet has excellent rollability. Although the cast sheet may have any size, an excessive thickness may result in segregation. Thus, the cast sheet preferably has a thickness of 10 mm or less, more preferably 5 mm or less. In particular, in a coiled long cast sheet even having a small diameter, the long cast sheet can be wound without causing a crack when a portion of the long cast sheet just before coiling is heated to 150° C. or more. A coiled long cast sheet having a large diameter may be wound at low temperature.

(Solution Process)

The cast sheet is subjected to solution treatment to make its composition uniform and manufacture a solid solution sheet containing an element, such as Al, dissolved therein. The solution treatment is preferably performed at a holding temperature of 350° C. or more, more preferably in the range of 380° C. to 420° C., at a holding time in the range of 60 to 2400 minutes (1 to 40 hours). The holding time is preferably increased as the Al content increases. In a cooling process after the holding time has passed, forced cooling, such as water cooling or air blast, is preferably used to increase the cooling rate (for example, 50° C./min or more), because this can reduce the precipitation of coarse precipitate particles.

(Rolling Process)

In the rolling process of the solid solution sheet, the material (the solid solution sheet or a sheet during rolling) can be heated to improve plastic formability. Thus, at least one pass of warm rolling is performed. However, an excessively high heating temperature results in an excessively long holding time at a temperature in the range of 150° C. to 300° C., which may cause excessive growth or precipitation of a precipitate as described above, the seizure of the material, or a deterioration of the mechanical characteristics of a rolled sheet because of the coarsening of crystal grains in the material. Thus, also in the rolling process, the heating temperature is 300° C. or less, preferably 150° C. or more and 280° C. or less. Rolling the solid solution sheet more than once (multipass) can achieve a desired sheet thickness, decrease the average grain size of the material (for example, 10 μm or less), or improve plastic formability in rolling or press forming. The rolling may be performed under known conditions. For example, not only the material but also a reduction roll may be heated, or the rolling may be combined with non-preheat rolling or controlled rolling as disclosed in Patent Literature 1. Rolling with a small rolling reduction, such as finish rolling, may be performed at low temperature. Use of a lubricant in the rolling process can decrease frictional resistance during rolling and prevent the seizure of the material, thus facilitating rolling.

In multi-pass rolling, an intermediate heat treatment between passes may be performed provided that the holding time at a temperature in the range of 150° C. to 300° C. is included in the total time described above. Removal or reduction of strain, residual stress, or a texture introduced during plastic forming (mainly rolling) before the intermediate heat treatment into a material to be processed can prevent accidental cracking, strain, or deformation during the subsequent rolling, thus facilitating rolling. Also in the intermediate heat treatment, the holding temperature is 300° C. or less, preferably 250° C. or more and 280° C. or less.

(Straightening Process)

A rolled sheet manufactured in the rolling process may be subjected to the final heat treatment (the final annealing) as described in Patent Literature 1. However, warm straightening described above is preferable to the final heat treatment in terms of plastic formability in press forming. Straightening may be performed by heating the rolled sheet to a temperature in the range of 100° C. to 300° C., preferably 150° C. or more and 280° C. or less, with a roller leveler that includes a plurality of staggered rollers as described in Patent Literature 2. Plastic forming, such as press forming, of a straightened sheet after warm straightening causes dynamic recrystallization, which improves plastic formability. Reduction in the thickness of a material by means of rolling can greatly decrease the holding time in the straightening process. For example, depending on the thickness of a material, the holding time may be a few minutes or even less than one minute.

(Plastic Forming Process)

Plastic forming, such as press forming, of the rolled sheet, a heat-treated sheet formed by the final heat treatment of the rolled sheet, a straightened sheet formed by the straightening of the rolled sheet, or a polished sheet formed by polishing (preferably wet polishing) of the rolled sheet, heat-treated sheet, or straightened sheet is preferably performed at a temperature in the range of 200° C. to 300° C. to improve plastic formability of the material. The time of holding a material at a temperature in the range of 200° C. to 300° C. in plastic forming is very short, for example, less than 60 seconds in certain press forming. Such a very short holding time causes substantially no failure, such as coarsening of a precipitate.

Heat treatment after plastic forming can remove strain or residual stress caused by the plastic forming and improve the mechanical characteristics of the sheet. The heat-treatment conditions include a heating temperature in the range of 100° C. to 300° C. and a heating time in the range of approximately 5 to 60 minutes. The holding time at a temperature in the range of 150° C. to 300° C. in the heat treatment is included in the total time described above.

(Total Time of Holding Material in Particular Temperature Range)

The main features of processes up to the process of producing the end product after the solution process in the manufacture of the substrate or the magnesium alloy sheet are that the total time of holding a material at a temperature of 150° C. or more and 300° C. or less is controlled in the range of 0.5 to 12 hours and that the material is not heated to a temperature of more than 300° C. For a magnesium alloy having an Al content of more than 7.5% by mass, the total time of holding a material at a temperature in the range of 150° C. to 300° C. in processes up to the process of producing the end product after solution treatment has not sufficiently been studied. As described above, the holding time in a temperature range in which a precipitate is easily formed or a product easily grows can be controlled in a particular range to provide a substrate or a magnesium alloy sheet that contains a certain number of fine precipitate particles dispersed therein.

When the total time of holding at a temperature in the range of 150° C. to 300° C. is less than 0.5 hours, a precipitate is not sufficiently precipitated. A total time of more than 12 hours or rolling of a material at a temperature of more than 300° C. results in the formation of coarse precipitate particles having a particle size of 1 μm or more or an excessive amount, for example, more than 20% by area, of precipitate. Preferably, the degree of processing in each pass in the rolling process, the total degree of processing in the rolling process, the conditions for intermediate heat treatment, and the conditions for straightening are controlled such that the temperature range is 150° C. or more and 280° C. or less and that the total time is 0.5 hours or more (more preferably one hour or more) and 6 hours or less. Since the precipitate increases with increasing Al content, the total time is preferably controlled also in a manner that depends on the Al content.

(Surface Treatment Process)

The substrate of a magnesium alloy structural member according to the present invention is typically the rolled sheet described above, a heat-treated sheet formed by the final heat treatment of the rolled sheet, a straightened sheet formed by the straightening of the rolled sheet, or a formed product manufactured by plastic forming of any of these sheets. The substrate is subjected to chemical conversion treatment. The chemical conversion treatment may be performed appropriately using a known chemical conversion treatment liquid under known conditions. A chromium-free treatment liquid, such as a manganese and calcium phosphate solution, is preferably used.

The chemical conversion treatment may be performed on a material before the plastic forming. The chemical conversion treatment of a formed product after plastic forming can prevent an anticorrosive layer formed by the chemical conversion treatment from being damaged during the plastic forming.

Coating after the chemical conversion treatment for the purpose of protection or ornamentation can further improve corrosion resistance or increase commercial value.

Advantageous Effects of Invention

A magnesium alloy structural member according to the present invention has excellent corrosion resistance.

BRIEF DESCRIPTION OF DRAWINGS

FIG. 1(I) shows a sample No. 1, and FIG. 1(II) shows a sample No. 110.

FIG. 1(I) shows the sample No. 1 (×250,000), and FIG. 1(II) shows the sample No. 110 (×100,000).

DESCRIPTION OF EMBODIMENTS

Figure 1:
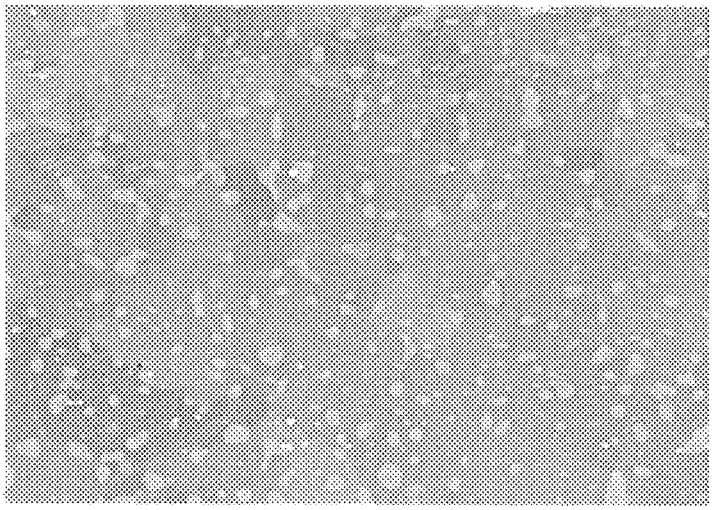
FIG. 1 shows photomicrographs (×5000) of a magnesium alloy sheet.
Figure 1:
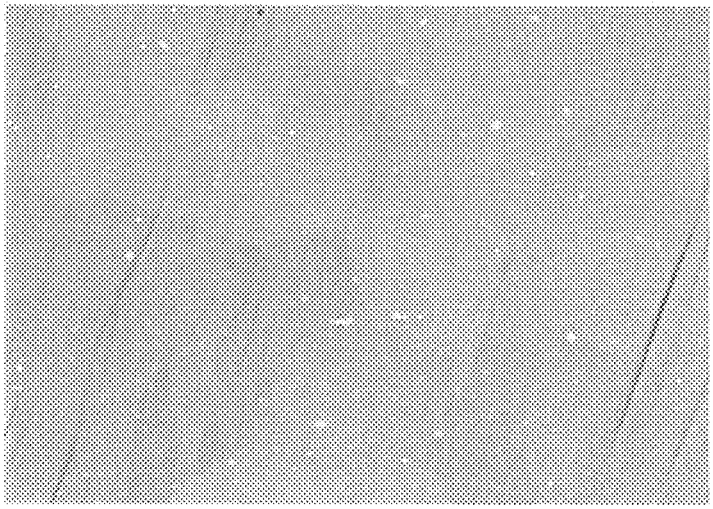

Embodiments of the present invention will be described below.

Test Examples

A substrate of a magnesium alloy sheet was subjected to chemical conversion treatment to prepare a magnesium alloy structural member having an anticorrosive layer. The metallographic structure of the substrate, the morphology of the anticorrosive layer, and corrosion resistance were examined.

Sample No. 1

A magnesium alloy structural member of sample No. 1 is prepared by the processes of casting, solution treatment, (warm) rolling, (warm) straightening, polishing, and the formation of an anticorrosive layer in this order.

In this test, a plurality of cast sheets (having a thickness of 4 mm) were prepared. The cast sheets were made of a magnesium alloy having a composition corresponding to AZ91 alloy (Mg-9.0% Al-1.0% Zn (based on mass)) and were formed by a twin-roll continuous casting process. The cast sheets were subjected to solution treatment at 400° C. for 24 hours. The solid solution sheet subjected to the solution treatment was rolled more than once to a thickness of 0.6 mm under the following rolling conditions.

(Rolling Conditions)

Degree of processing (rolling reduction): 5%/pass to 40%/pass

Heating temperature of sheet: 250° C. to 280° C.

Roll temperature: 100° C. to 250° C.

For the sample No. 1, in each pass of the rolling process, the heating time of a material to be rolled and the rolling speed (roll peripheral speed) were adjusted such that the total time of holding the material at a temperature in the range of 150° C. to 300° C. was 3 hours.

The rolled sheet was subjected to warm straightening at 220° C. to prepare a straightened sheet. The warm straightening was performed using distortion means described in Patent Literature 2.

The straightened sheet was polished by wet belt polishing with a #600 abrasive belt to prepare a polished sheet. The time of holding the material at a temperature in the range of 150° C. to 300° C. in the straightening process was very short, for example, a few minutes.

The polished sheet was subjected to degreasing, acid etching, desmutting, surface conditioning, chemical conversion treatment, and drying in this order to form an anticorrosive layer. The following are specific conditions. The resulting magnesium alloy structural member is hereinafter referred to as a sample No. 1.

Degreasing: 10% KOH and 0.2% nonionic surfactant solution under agitation, 60° C., 10 minutes Acid etching: 5% phosphate solution under agitation, 40° C., 1 minute Desmutting: 10% KOH solution under agitation, 60° C., 10 minutes Surface conditioning: aqueous carbonate solution adjusted to pH 8, under agitation, 60° C., 5 minutes Chemical conversion treatment: trade name Grander MC-1000 (calcium and manganese phosphate chemical coating agent) manufactured by Million Chemicals Co., Ltd., a treatment liquid temperature of 35° C., a dipping time of 60 seconds Drying: 120° C., 20 minutes Sample No. 100

A cast material (having a thickness of 4.2 mm) prepared in the same manner as in the sample No. 1 was rolled under the following conditions and was subjected to heat treatment at 320° C. for 30 minutes instead of (warm) straightening. The heat-treated sheet was polished in the same manner as in the sample No. 1, and an anticorrosive layer was then formed. The resulting magnesium alloy structural member is hereinafter referred to as a sample No. 100.

(Rolling Conditions)

[Rough rolling] From 4.2 mm to 1 mm in thickness

Degree of processing (rolling reduction): 20%/pass to 35%/pass

Heating temperature of sheet: 300° C. to 380° C.

Roll temperature: 180° C.

[Finish rolling] From 1 mm to 0.6 mm in thickness

Degree of processing (rolling reduction): average 7%/pass

Heating temperature of sheet: 220° C.

Roll temperature: 170° C.

The total time of holding at a temperature in the range of 150° C. to 300° C. after solution treatment in the sample No. 100 was 15 hours.

Sample No. 110

A wrought material (a sheet having a thickness of 0.6 mm) made of commercially available AZ31 alloy was polished in the same manner as in the sample No. 1, and an anticorrosive layer was then formed. The resulting magnesium alloy structural member is hereinafter referred to as a sample No. 110.

Sample No. 120

A wrought material (a sheet having a thickness of 0.6 mm) made of commercially available AZ91 alloy was polished in the same manner as in the sample No. 1, and an anticorrosive layer was then formed. The resulting magnesium alloy structural member is hereinafter referred to as a sample No. 120.

The metallographic structures of the substrate of the sample No. 1 (straightened sheet) and the substrate of the sample No. 100 (heat-treated sheet) thus manufactured and the AZ31 alloy wrought material of the sample No. 110 thus prepared were observed to examine a precipitate in the following manner.

The substrates and the wrought material were cut in the thickness direction, and the cross sections were observed with a scanning electron microscope (SEM) (×5000). FIG. 1(I) shows an image of the sample No. 1, and FIG. 1(II) shows an image of the sample No. 110. In FIG. 1, light gray (white) grains are precipitates.

The ratio of the total area of the precipitate particles to the cross section was determined in the following manner. Three fields (22.7 μm×17 μm) were determined for each image of five cross sections of each of the substrates and the wrought material. The total area of all the precipitate particles in one observation field was calculated from the area of each of the precipitate particles. The ratio (total particle area)/(observation field area) of the total area of all the particles in one observation field to the area of the observation field (385.9 $\mu m^2$) was determined. The ratio is hereinafter referred to as an observation field area percentage. Table shows the average of 15 observation field area percentages for each of the substrates and the wrought material.

The ratio of the average particle size of the precipitate particles to the cross section was determined in the following manner. For each observation field, the diameter of a circle having an area equivalent to the area of each particle in one observation field was determined to prepare a particle size histogram. When the particle areas integrated from a smallest particle area reaches 50% of the total particle area of an observation field, the particle size at that point, that is, the 50% particle size (area) is the average particle size of the observation field. Table shows the average particle size of 15 observation fields for each of the substrates and the wrought material.

The area and diameter of the particles can be easily determined with a commercial image processor. An analysis by energy dispersive X-ray spectroscopy (EDS) showed that the precipitates were made of an intermetallic compound containing Al or Mg, such as $Mg_{17}Al_{12}$. The presence of particles made of the intermetallic compound can also be detected by analyzing the composition and structure of the particles by X-ray diffraction.

Figure 2:
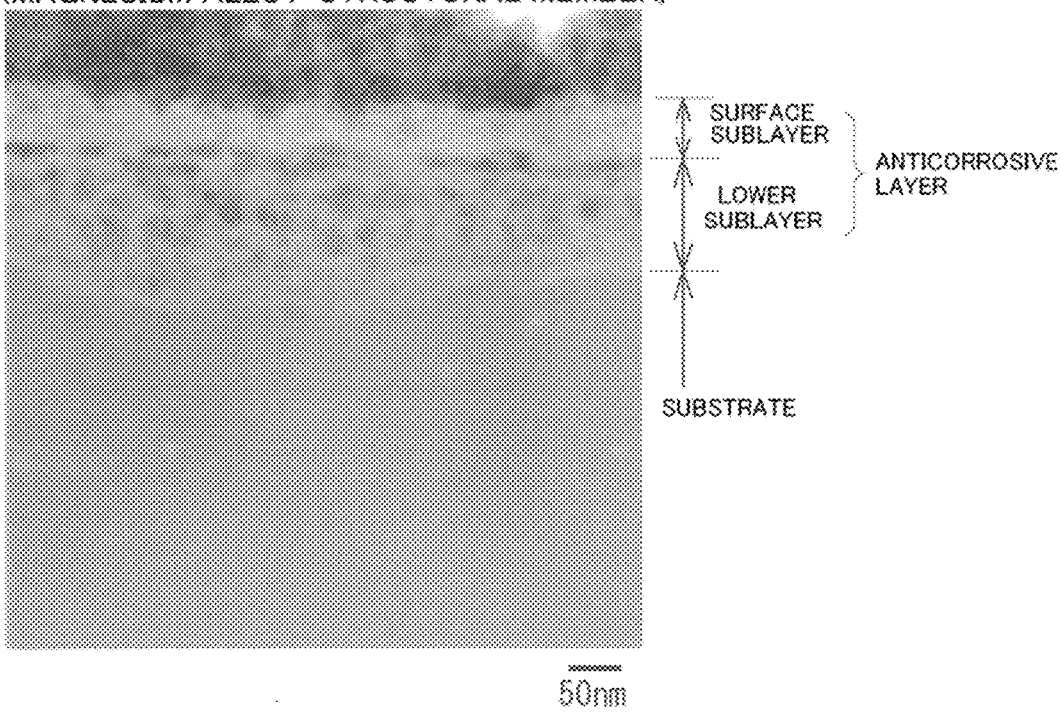
FIG. 2 shows photomicrographs of a cross section of a magnesium alloy structural member having an anticorrosive layer.
Figure 2:
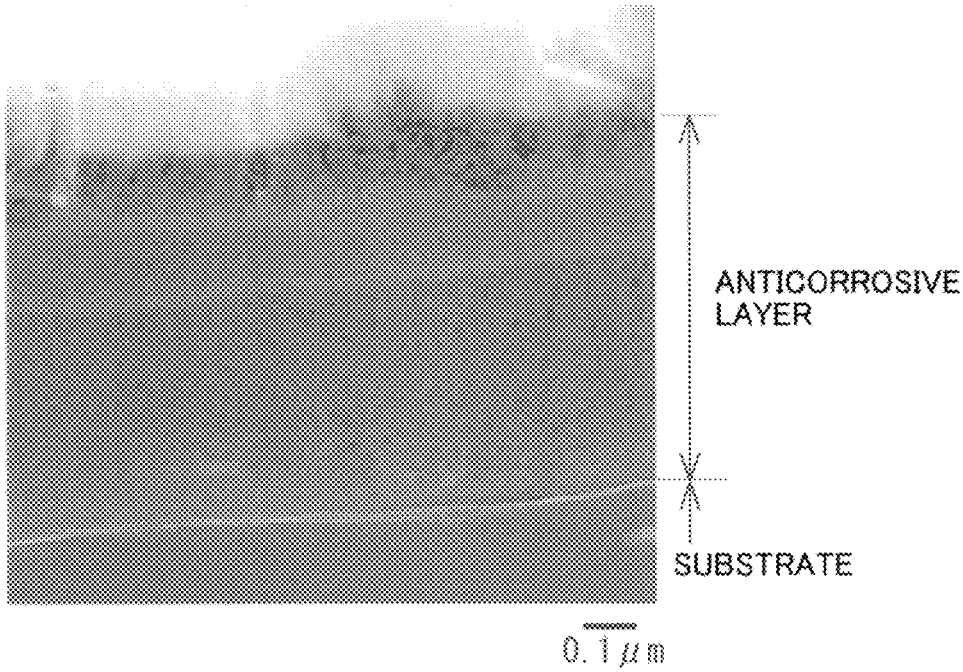

An anticorrosive layer formed by chemical conversion treatment on a cross section of a sample (magnesium alloy structural member) in the thickness direction was observed with a transmission electron microscope (TEM). FIG. 2(I) shows an image of the sample No. 1 (×250,000), and FIG. 2(II) shows an image of the sample No. 110 (×100,000). A black region in the upper portion of FIG. 2(I) and a white region in the upper portion of FIG. 2(II) were protective layers formed in the preparation of the cross sections.

Table shows the median and dispersion of an image of the anticorrosive layer with a 256 gray scale (an intermediate value method) (n=1). The median and dispersion of the gray scale can be easily determined with a commercial image processor. A small dispersion indicates a dense state with a small number of pores, and a large dispersion indicates a porous state with a large number of pores.

The thickness (the average of the thicknesses at five points in the image) of the anticorrosive layer in each of the samples was determined from their images. Table shows the results.

The corrosion resistance of the samples was determined in a corrosion resistance test. The corrosion resistance test conformed to JIS Z 2371 (2000) (salt spray time: 96 hours, 35° C.), and a variation in weight (corrosion loss) caused by salt spray was measured. The variation in weight of more than 0.6 mg/cm$^2$ was rated poor (a cross in Table), 0.6 mg/cm$^2$ or less was rated good (circle), and less than 0.4 mg/cm$^2$ was rated excellent (double circle). Table shows the results.

layer is porous with a lower gray scale (median) and a larger dispersion than the surface sublayer, and the surface sublayer is dense with a higher gray scale and a smaller dispersion than the lower sublayer. An analysis of the composition of the anticorrosive layer with an energy dispersive X-ray spectrometer (EDX) showed that the main component was a phosphate compound of manganese and calcium, the lower sublayer adjacent to the substrate had a higher Al content than the surface sublayer, and the surface sublayer had a higher manganese and calcium content than the lower sublayer.

Table shows that the sample No. 1 having the structure described above had excellent corrosion resistance.

In contrast, the sample No. 110 formed of the AZ31 alloy wrought material contained a very small number of precipitates as shown in FIG. 1(II) and had a very thick porous anticorrosive layer as shown in FIG. 2(II). Furthermore, Table shows that the sample No. 110 had poor corrosion resistance. This is probably because the anticorrosive layer did not include a dense surface sublayer such as that in the sample No. 1 and was porous and thick, which accelerated the permeation of a corrosive liquid through a crack, and also because the substrate contained small amounts of Al (dissolved Al) and intermetallic compound.

In the sample No. 120 formed of the AZ91 alloy cast material, the anticorrosive layer was more porous than the surface sublayer of the sample No. 1 and thicker than the sample No. 1. The sample No. 120 was inferior in corrosion resistance to the sample No. 1. This is probably because the thick film caused a crack and thereby accelerated the permeation of a corrosive liquid.

Table also shows that the area percentage of the precipitate in the sample No. 100 subjected to heat treatment of more

TABLE

| | | Intermetallic compound (precipitate) | | Anticorrosive layer | | | | | | |
|---|---|---|---|---|---|---|---|---|---|---|
| | | Average particle | Area percentage | Median | | Dispersion | | Thickness (nm) | | |
| Sample No. | Composition | size (μm) | (% by area) | Lower sublayer | Surface sublayer | Lower sublayer | Surface sublayer | Lower sublayer | Surface sublayer | Corrosion resistance |
| 1 | AZ91 | 0.1 | 6 | 120 | 150 | 14 | 8 | 150 | 50 | ◎ |
| 100 | AZ91 | 0.2 | 15 | 120 | | 10 | | 100 | | ○ |
| 110 | AZ31 Wrought material | 0.07 | 0.4 | 80 | | 18 | | 600 | | X |
| 120 | AZ91 cast material | — | — | — | | — | | — | | ○ |

Table shows that when the total time of holding a material at a temperature in the range of 150° C. to 300° C. after solution treatment is in a particular range and when the material is not heated to more than 300° C., the resulting magnesium alloy sheet (the substrate of the sample No. 1) contains fine particles of an intermetallic compound (precipitates) dispersed therein, as shown in FIG. 1(I). More specifically, in this substrate, the average size of the intermetallic compound particles is 0.05 μm or more and 1 μm or less, and the total area of the intermetallic compound particles accounts for 1% or more and 20% or less.

As shown in FIG. 2(I), the anticorrosive layer on the substrate of the sample No. 1 has a two-layer structure that includes a relatively thick lower sublayer adjacent to the substrate in the thickness direction and a relatively thin surface sublayer on the front side. In particular, the lower subthan 300° C. is larger than that in the sample No. 1. The anticorrosive layer of the sample No. 100 is more porous than the surface sublayer of the sample No. 1 and is inferior in corrosion resistance to the sample No. 1. This is probably because the substantial absence of the dense surface sublayer allowed the corrosive liquid to permeate more easily than the sample No. 1.

These results show that a substrate made of a magnesium alloy having an Al content of more than 7.5% by mass and prepared in the manufacturing processes after solution treatment such that the total time of holding at a temperature in the range of 150° C. to 300° C. is in the range of 0.5 to 12 hours and that the substrate is not heated to a temperature of more than 300° C. can be subjected to chemical conversion treatment to manufacture a magnesium alloy structural member having excellent corrosion resistance.

These embodiments may be modified without departing from the gist of the present invention and are not limited to the constituents described above. For example, the composition (in particular, the Al content) of the magnesium alloy, the thickness and shape of the magnesium alloy sheet, and the constituent materials of the anticorrosive layer may be modified.

INDUSTRIAL APPLICABILITY

A magnesium alloy structural member according to the present invention can be suitably used in various parts of electronic devices, in particular, housings for mobile or small electronic devices, and parts in various applications that require high strength, for example, parts of automobiles.

The invention claimed is:

1. A magnesium alloy structural member, comprising: a magnesium alloy substrate that contains more than 7.5% by mass of Al; and an anticorrosive layer formed on a surface of the substrate by chemical conversion treatment, wherein the substrate contains precipitate particles dispersed therein, the precipitate particles have an average particle size of 0.05 μm or more and 1 μm or less, the total area of the precipitate particles in a cross section of the magnesium alloy structural member accounts for 1% or more and 20% or less of the cross section, and the anticorrosive layer includes a lower sublayer adjacent to the substrate and a surface sublayer formed on top of the lower sublayer, the surface sublayer being denser than the lower sublayer.

2. The magnesium alloy structural member according to claim 1, wherein the precipitate particles include particles made of an intermetallic compound containing at least one of Al and Mg.

3. The magnesium alloy structural member according to claim 1, wherein in a microscope image of a cross section of the magnesium alloy structural member, with respect to the anticorrosive layer with a 256 gray scale, the surface sublayer has a dispersion in gray scale of 6 or more and 10 or less, and the lower sublayer has a dispersion in gray scale of 13 or more and 17 or less.

4. The magnesium alloy structural member according to claim 1, wherein the anticorrosive layer has a total thickness of 50 nm or more and 300 nm or less.

5. The magnesium alloy structural member according to claim 1, wherein the anticorrosive layer is mainly composed of a phosphate compound of manganese and calcium.

* * * * *